US010189689B1

(12) United States Patent
Lyon

(10) Patent No.: US 10,189,689 B1
(45) Date of Patent: Jan. 29, 2019

(54) AUTOMOBILE JACK SYSTEM

(71) Applicant: Jeff M Lyon, Olathe, KS (US)

(72) Inventor: Jeff M Lyon, Olathe, KS (US)

( * ) Notice: Subject to any disclaimer, the term of this patent is extended or adjusted under 35 U.S.C. 154(b) by 0 days.

(21) Appl. No.: 15/886,343

(22) Filed: Feb. 1, 2018

(51) Int. Cl.
*B66F 7/06* (2006.01)
*B66F 7/24* (2006.01)

(52) U.S. Cl.
CPC ..... *B66F 7/0608* (2013.01); *B66F 7/065* (2013.01); *B66F 7/243* (2013.01)

(58) Field of Classification Search
CPC ..... B66F 7/0608; B66F 7/065; B66F 7/243; B66F 3/12; B66F 5/00; B66F 7/0675
USPC ..... 254/88
See application file for complete search history.

(56) References Cited

U.S. PATENT DOCUMENTS 5,445,353 A * 8/1995 Sakamoto ..... A61D 3/00 108/10
5,855,359 A 1/1999 Chipperfield
6,045,122 A * 4/2000 Torres ..... B66F 7/0608 254/122
D750,338 S 2/2016 Ruotsalainen
2003/0160221 A1* 8/2003 Dunbar, Sr. ..... B66F 3/30 254/88
2009/0200527 A1* 8/2009 Christie ..... B66F 3/12 254/122
2012/0241698 A1* 9/2012 Swasey ..... B66F 3/22 254/122
2013/0193392 A1* 8/2013 McGinn ..... B66F 7/065 254/93 R
2015/0034893 A1* 2/2015 Bacon ..... B66F 7/0658 254/290
2017/0030092 A1* 2/2017 Young ..... E04F 21/00
2017/0283225 A1* 10/2017 Crymble ..... B66F 3/12

* cited by examiner

*Primary Examiner* — Christopher M Koehler
*Assistant Examiner* — Seahee Yoon
(74) *Attorney, Agent, or Firm* — Dale J. Ream

(57) ABSTRACT

An automobile jack includes a housing having opposed side and end walls defining an interior area. A ramp extends from the housing and includes upper and lower ends. A platform defines a tire-receiving surface. The automobile jack includes a first linkage having an upper arm pivotally connected to a lower arm along a first horizontal axis and a second linkage having an upper arm pivotally connected to a lower arm along a second horizontal axis. Each upper arm is pivotally connected to the platform and each lower arm is pivotally connected to the housing. A threaded yoke is coupled to the second linkage. The jack includes a power screw for selectively changing a distance between the first and second horizontal axes to move the platform between a retracted configuration at which the tire-receiving surface even with the ramp and a raised configuration above the ramp.

10 Claims, 17 Drawing Sheets

AUTOMOBILE JACK SYSTEM

BACKGROUND OF THE INVENTION

This invention relates generally to lifting devices and, more particularly, to an automobile jack or jack system that includes a low-profile ramp coupled to a housing having a jack linkage therein and that enables a tire of an automobile to drive onto a tire receiving surface atop the housing without damaging a low-profile spoiler or automobile trim piece and to be raised when the jack is actuated.

Changing the oil of an automobile typically involves driving the car up a ramp onto a lifting assembly. For instance, traditional automotive shops as well as amateurs may require the automobile to drive up steep ramps until the car is suspended sufficiently above a ground surface to enable a mechanic (whether professional or the vehicle owner) to slide under the vehicle and conduct the oil change or otherwise work on a repair. Unfortunately, driving a low-profile automobile or one having a spoiler or low-hanging trim piece results in the spoiler becoming bent or otherwise damaged when it encounters the ramp or ground.

Another problem with traditional jacks for lifting an automobile is that they require positioning a linkage under a frame of the automobile and then actuating the jack to lift the vehicle. Unfortunately, traditional jacks—such as those carried in the trunk of an automobile—are unstable, are positioned adjacent to a tire of the automobile, and do not enable lifting the automobile evenly side-to-side. Although traditional jacks may be suitable for changing a flat tire should the driver find himself in such a situation while driving, they are not suitable for changing the oil in the automobile—where an unstable and inconvenient lifting the automobile could prove fatal to the vehicle owner lying under the automobile.

Therefore, it would be desirable to have a jack system for an automobile that allows an automobile to be driven onto the jack without damaging the automobile's spoiler or low-hanging components and from which point the automobile may be raised above the ground in a safe, secure, and stable manner. Further, it would be desirable to have a jack system in which a low-rise ramp is coupled to the jack housing and in which the tire receiving surface of the housing is literally raised as a jack linkage is actuated. In addition, it would be desirable to have a jack system in which multiple automobile jacks may be ganged together whereby to lift the entire front end or rear end of the automobile when just one automobile jack is actuated.

SUMMARY OF THE INVENTION

An automobile jack according to the present invention includes a housing having opposed side walls and opposed end walls, the side walls and the end walls collectively defining a perimeter of a hollow interior area, each the side wall defining a vertical channel with an open top end. A ramp extends from the housing at a respective the end wall and includes upper and lower ends. A platform defines a tire-receiving surface.

The automobile jack includes first and second linkages, the first linkage having an upper arm pivotally connected to a lower arm along a first horizontal axis, the second linkage having an upper arm pivotally connected to a lower arm along a second horizontal axis, each upper arm being pivotally connected to the platform, each lower arm being pivotally connected to the housing. A threaded yoke is coupled to the second linkage. The jack includes a power screw for selectively changing a distance between the first and second horizontal axes to thereby move the platform between a retracted configuration at which the tire-receiving surface is no higher than the upper end of the ramp and a raised configuration at which the tire-receiving surface is above the upper end of the ramp.

Therefore, a general object of this invention is to provide an automobile jack having a low profile ramp so that a low-profile vehicle can drive onto the ramp and be lifted without damaging a low hanging spoiler or trim on the automobile.

Another object of this invention is to provide an automobile jack, as aforesaid, in which the jack linkage is situated inside a housing coupled to the ramp until the linkage is actuated Still another object of this invention is to provide an automobile jack, as aforesaid, in which multiple jacks with ramps may be ganged together and actuated simultaneously.

Yet another object of this invention is to provide an automobile jack, as aforesaid, having a foot pedal that enables the housing to move laterally when actuated.

Other objects and advantages of the present invention will become apparent from the following description taken in connection with the accompanying drawings, wherein is set forth by way of illustration and example, embodiments of this invention.

DETAILED DESCRIPTION OF THE PREFERRED EMBODIMENT

Figure 5:
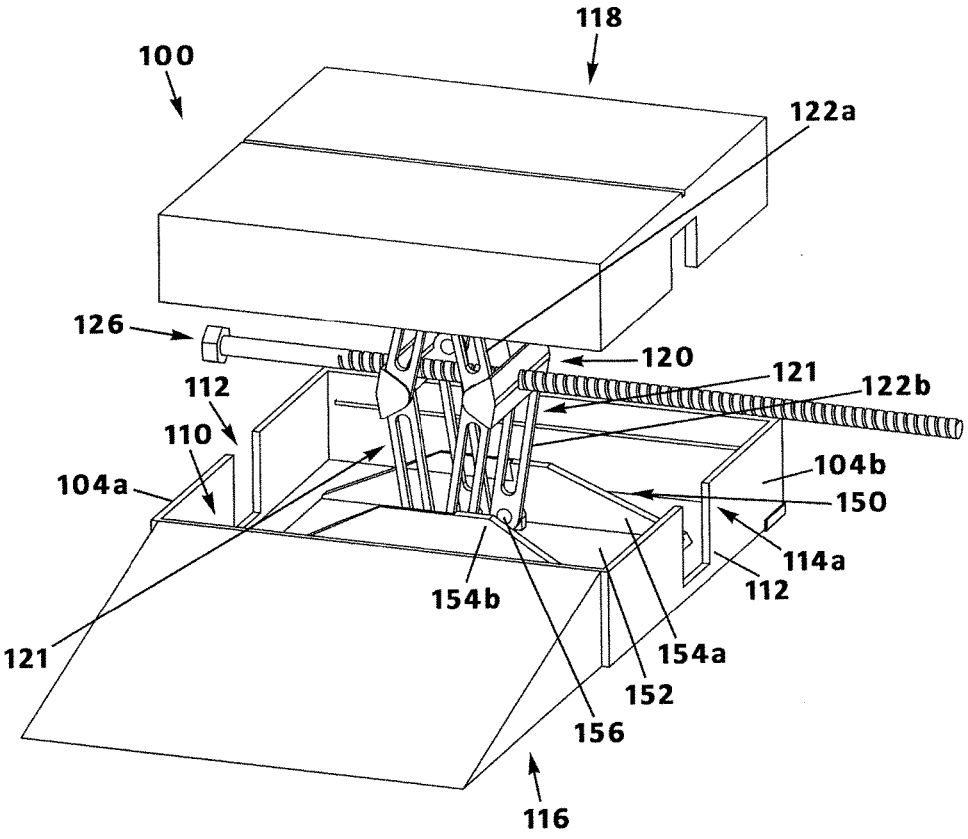
FIG. 5 is a front perspective view of the automobile jack according to FIG. 1 in a raised configuration.
Figure 6:
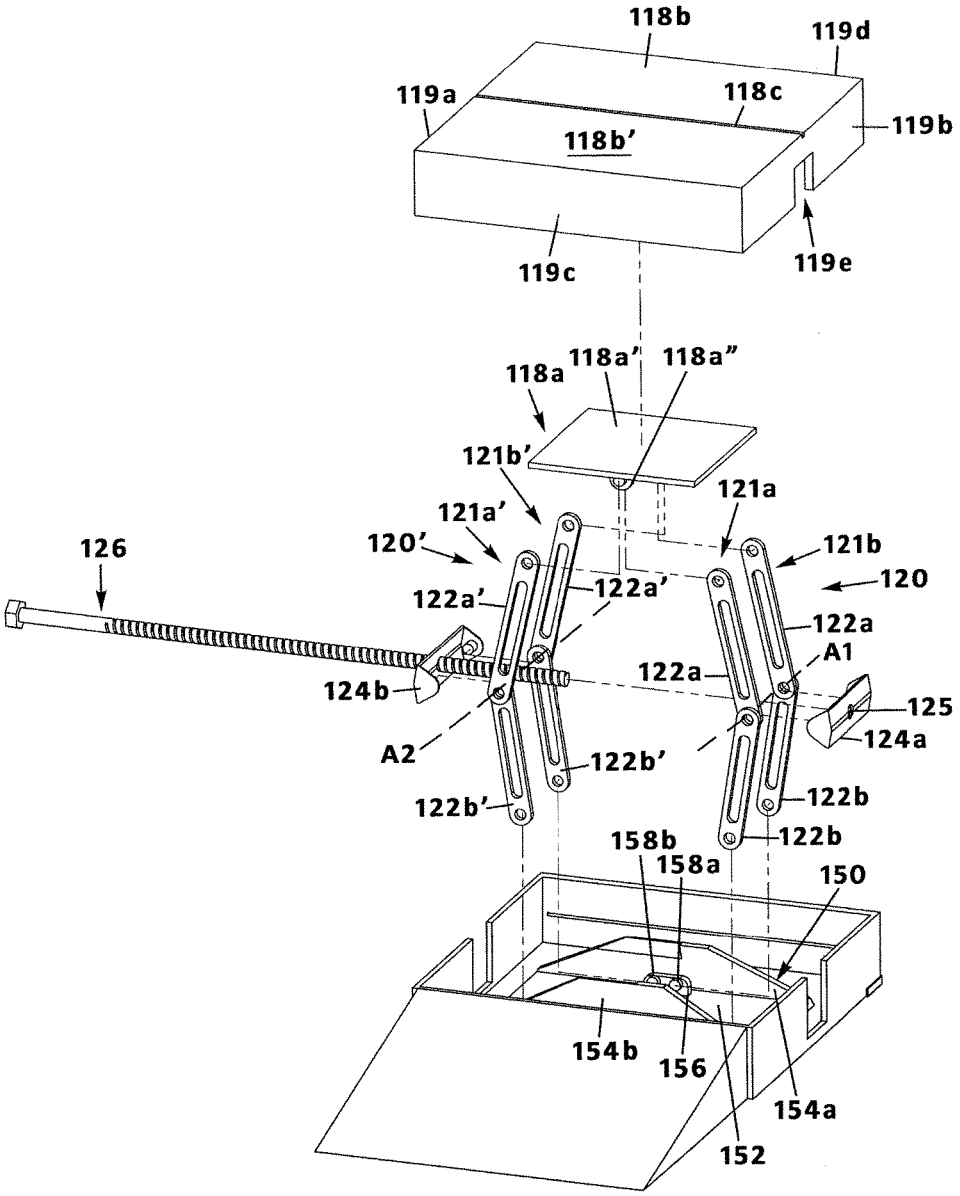
FIG. 6 is an exploded perspective view of the automobile jack according to FIG. 5.
Figure 7A:
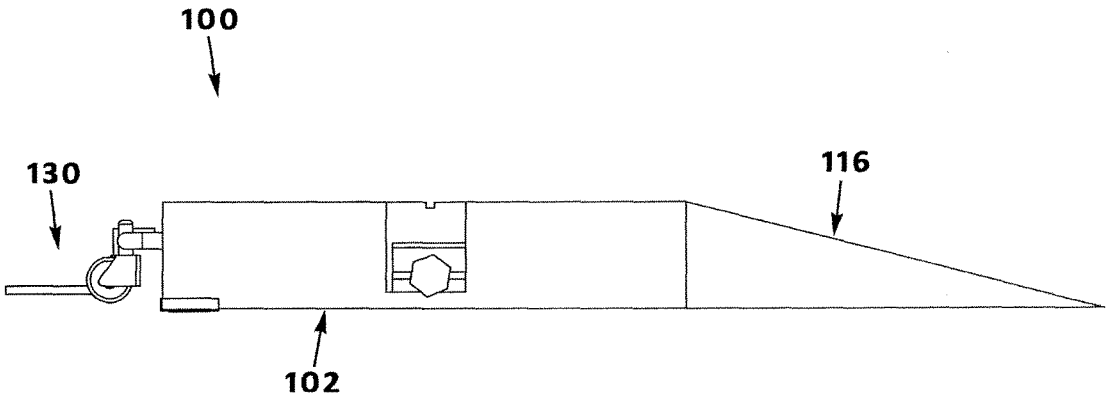
FIG. 7*a* is a side view of the automobile jack according to FIG. 1.
Figure 7B:
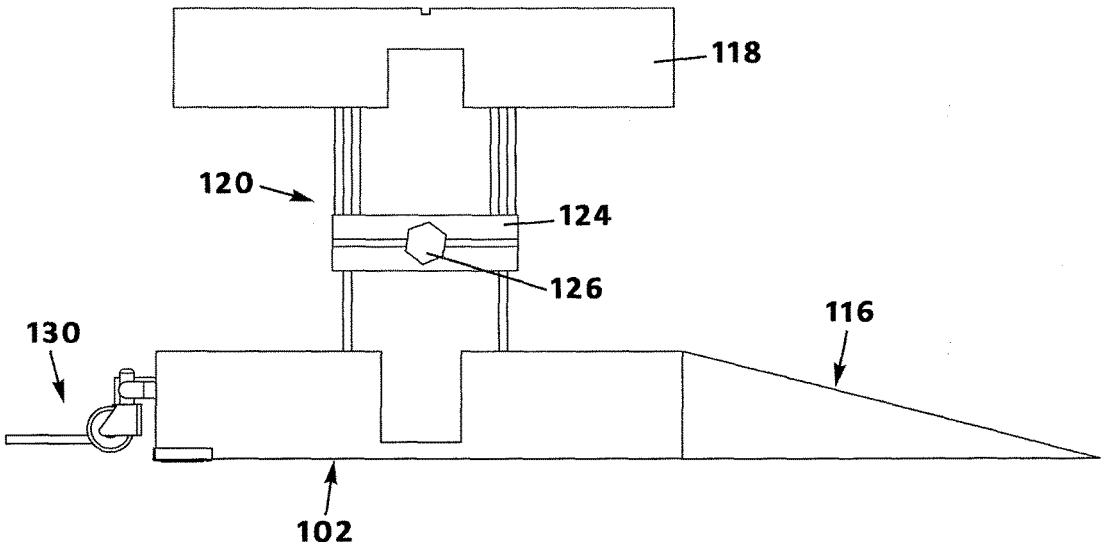
FIG. 7*b* is a side view of the automobile jack according to FIG. 5.

Embodiments of automobile jacks are described herein. With reference to figures, and specifically FIGS. 1, 2, 5, and 6, an automobile jack 100 includes a housing 102 for receiving a platform 118 which moves between a retracted configuration (FIG. 7*a*) and a raised configuration (FIG. 7*b*), and a ramp 116 extending from the housing 102. The housing 102 has opposed first and second side walls 104*a* and 104*b*, and opposed first and second end walls 106*a* and 106*b*. Together, the walls 104*a*, 104*b*, 106*a*, and 106*b* define a perimeter 108 of a hollow interior area 110 of the housing 102 (FIG. 5). The side walls 104*a* and 104*b* each define a respective vertical channel 112, each vertical channel 112 having an open top end 114.

Situated within the hollow interior area 110 of the housing 102 is a brace 150 defining a base 152 and opposing side walls 154*a* and 154*b*. Attachment members 156 are situated along an inside edge of the opposing side walls 154*a* and 154*b* for mating with the linkages 120 as described below.

The platform 118 has a first portion 118*a* and a second portion 118*b*. The first portion 118*a* includes a substantially planar surface 118*a*' and attachment members 118*a*" configured to mate with linkages 120 as described below. The first portion 118*a* is overlaid by the second portion 118*b*.

The second portion 118*b* defines the tire-receiving surface 118*b*', and a recessed area 118*c* may be formed along the tire-receiving surface 118*b*' for receiving a tire of a vehicle. Opposing side walls 119*a* and 119*b* and opposing end walls 119*c* and 119*d* extend downwardly from the tire-receiving surface 118*b* to form the second portion 118*b*. Each side wall 119*a* and 119*b* define a vertical channel 119*e* with an open bottom end. The respective vertical channels 119*e* in the side walls 119*a* and 119*b* may generally correspond to the respective vertical channels 112 in the side walls 104*a* and 104*b*.

Linkages 120 are disposed within the hollow interior area 110 of the housing 102. Each linkage 120 includes at least one support 121, and in some embodiments, includes two supports 121. Each support 121 has an upper arm 122*a* pivotally connected to a lower arm 122*b* along a horizontal axis. The upper arm 122*a* is additionally pivotally connected to the attachment members 118*a*", and the lower arm 122*b* is pivotally connected to the housing 102 via the attachment members 156.

In an embodiment, first and second linkages 120 and 120' are disposed within the interior area 110, each linkage 120 and 120' having two supports 121 (respective front supports 121*a* and 121*a*' and back supports 121*b* and 121*b*') connected by a yoke 124. The upper arms 122*a* of the respective front and back supports 121*a* and 121*b* forming the first linkage 120 are pivotally connected to the lower arms 122*b* along a first horizontal axis A1 via yoke 124*a*. Likewise, the upper arms 122*a*' of the respective front and back supports 121*a*' and 121*b*' forming the second linkage 120' are pivotally connected to the lower arms 122*b*' along a second horizontal axis A2 via yoke 124*b*.

Figure 8A:
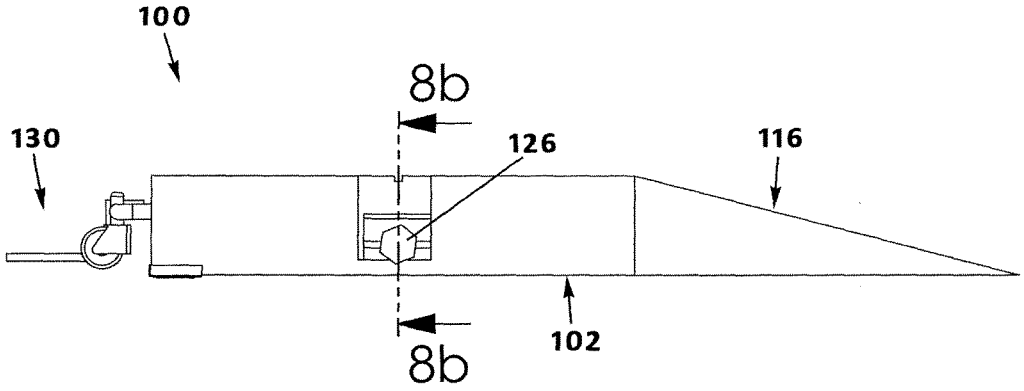
FIG. 8*a* is another side view of the automobile jack according to FIG. 1 showing section line 8*b*-8*b*.
Figure 8B:
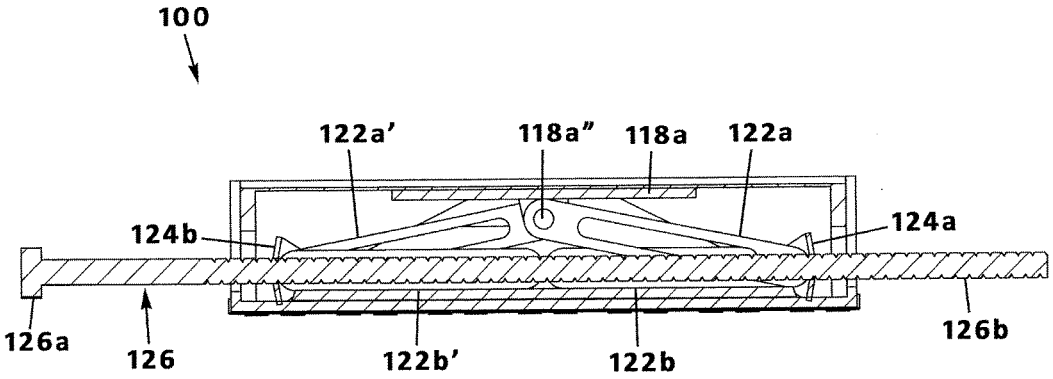
FIG. 8*b* is a section view of the automobile jack taken along section line 8*b*-8*b* wherein the automobile jack is in a retracted configuration.
Figure 8C:
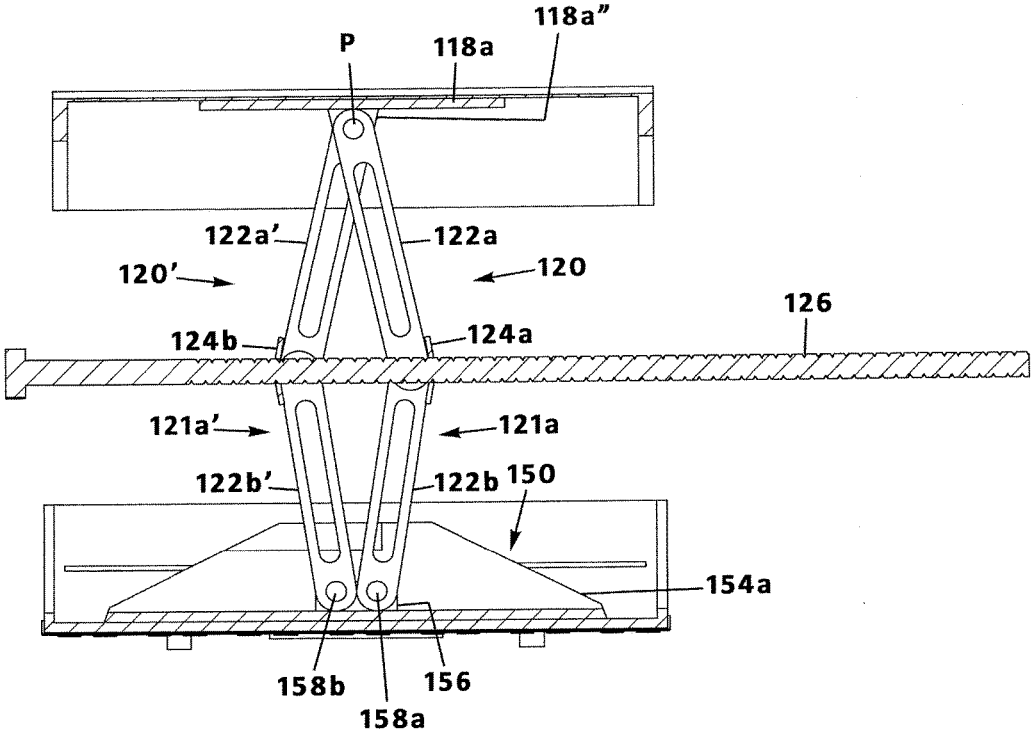
FIG. 8*c* is a section view of the automobile jack taken along section line 8*b*-8*b* wherein the automobile jack is in a raised configuration.

As shown in FIG. 8*c*, the respective upper arms 122*a* and 122*a*' of the front supports 121*a* and 121*a*' may be pivotally connected to the attachment member 118*a*" at point P. Likewise, the respective upper arms 122*a* of the of the back supports 121*b* and 121*b*' may be pivotally connected to the attachment member 118*a*" at a point corresponding to point P located on an opposite side of the attachment member 118*a*". The lower arms 122*b* and 122*b*' of the respective front supports 121*a* and 121*a*' may be slightly spatially separated when pivotally connected to the attachment member 156. Accordingly, the attachment member 156 may include two knobs 158*a* and 158*b*, each knob configured to mate with one of the lower arm 122*b* of the front support 121*a* or the lower arm 122*b*' of the front support 121*a*'. Likewise, the lower arms 122*b* and 122*b*' of the respective back supports 121*b* and 121*b*' are connected to an attachment member 156 in a similar manner.

Figure 1:
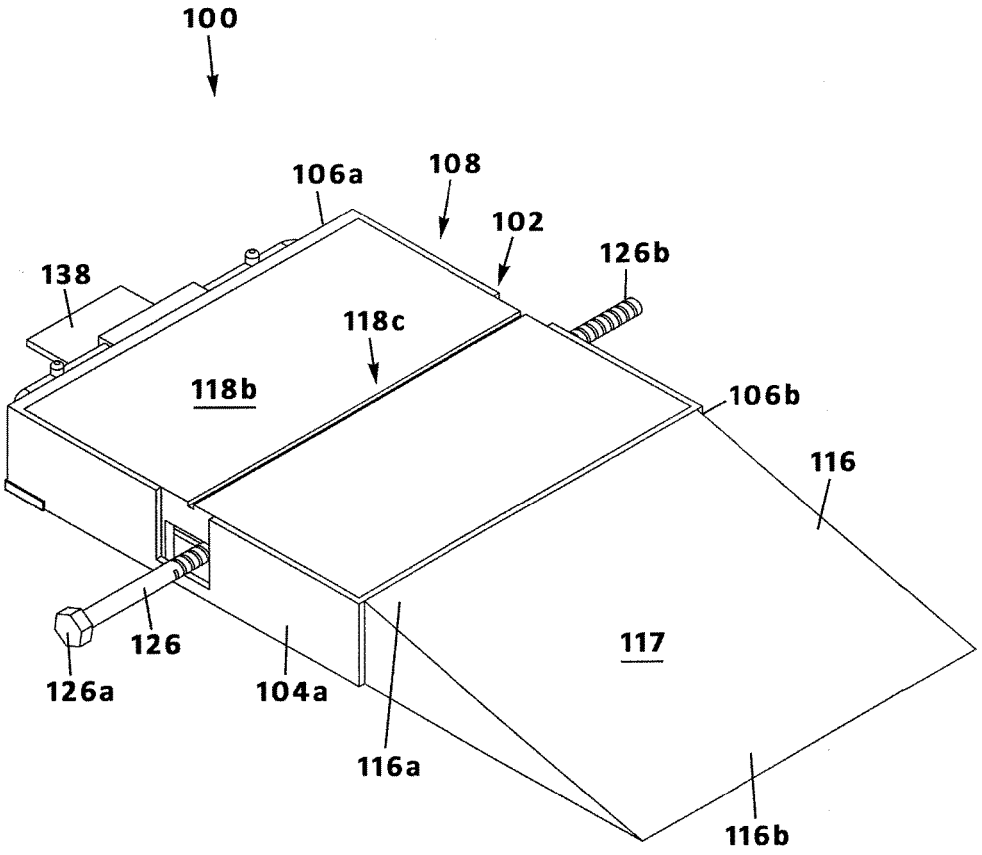
FIG. 1 is a front perspective view of an automobile jack in a retracted configuration according to an embodiment of the invention.
Figure 2:
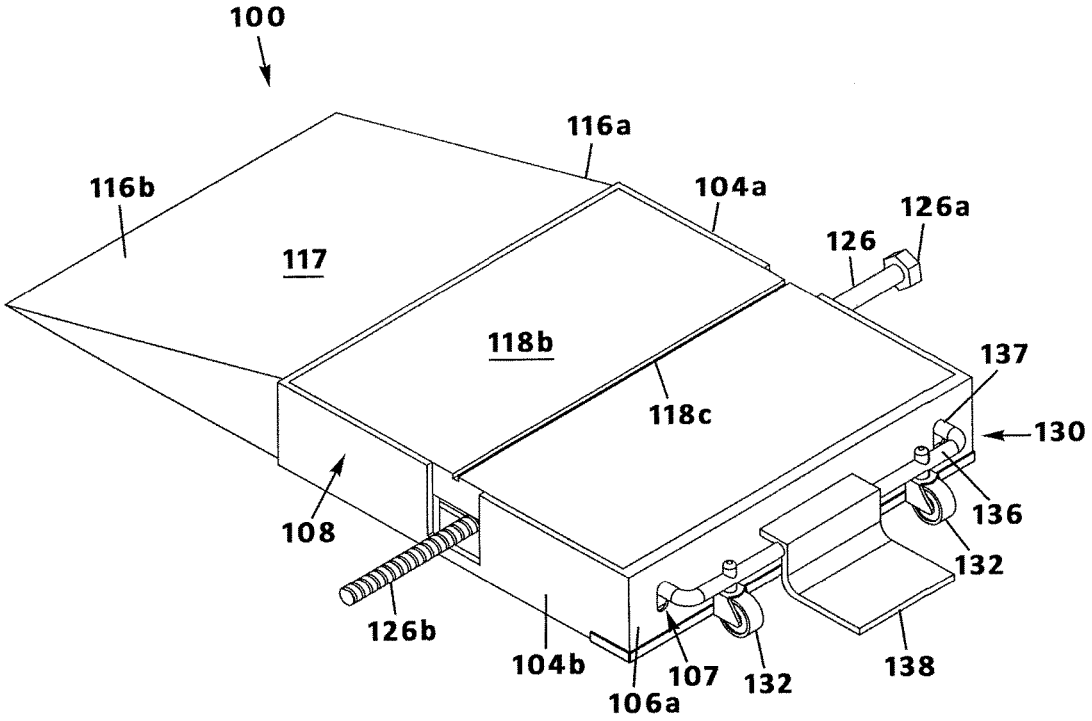
FIG. 2 is a rear perspective view of the automobile jack according to FIG. 1.
Figure 3A:
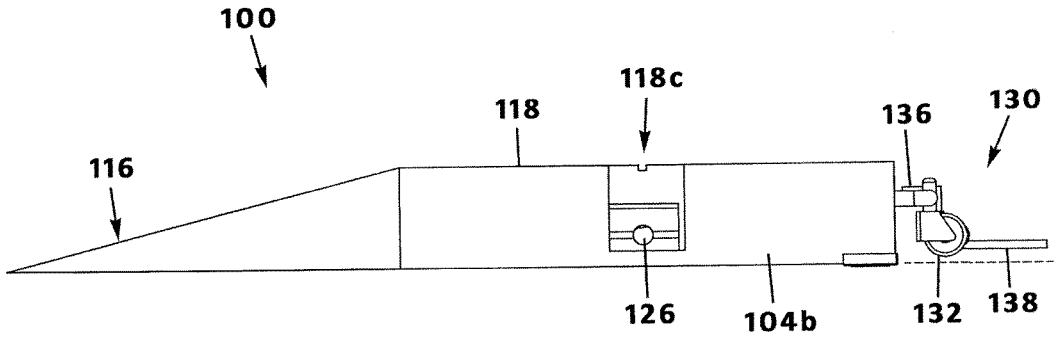
FIG. 3*a* is a side view of an automobile jack according to FIG. 1 showing a wheel assembly in a raised configuration.
Figure 3B:
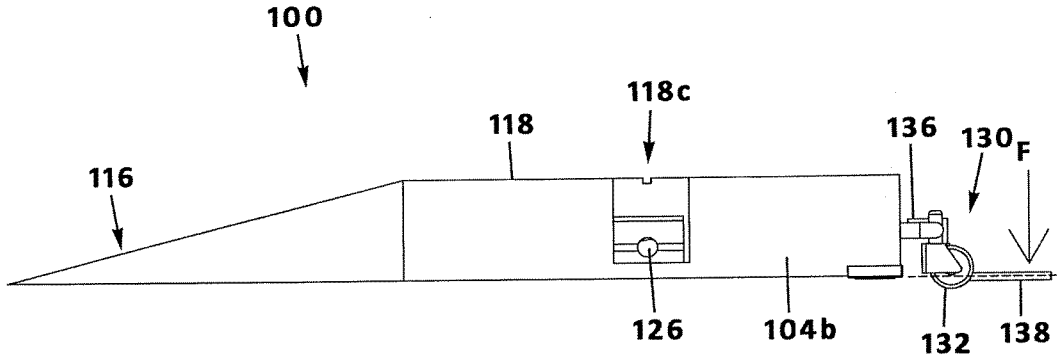
FIG. 3*b* is a side view of the automobile jack according to FIG. 1 showing a wheel assembly in a lowered configuration.
Figure 4A:
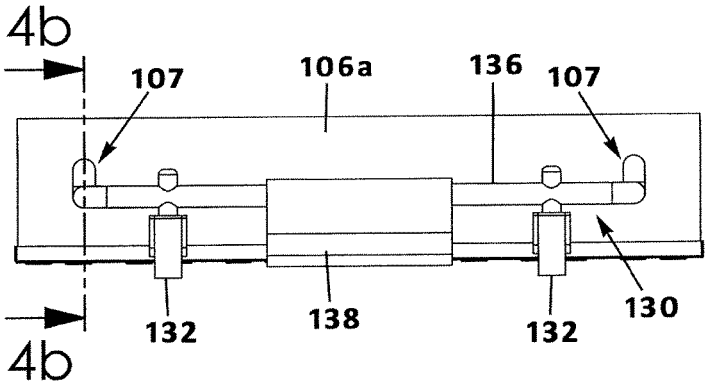
FIG. 4*a* is a rear view of the automobile jack according to FIG. 1.
Figure 4B:
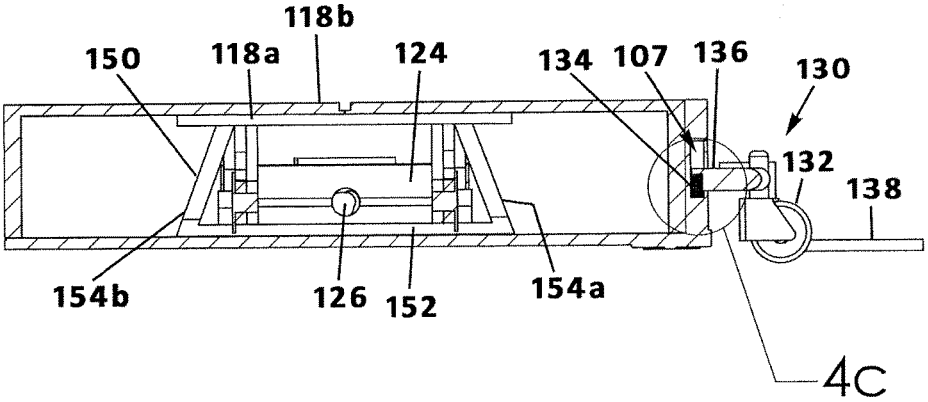
FIG. 4*b* is a section view of the automobile jack according to FIG. 1 taken along line 4*b*-4*b*.
Figure 4C:
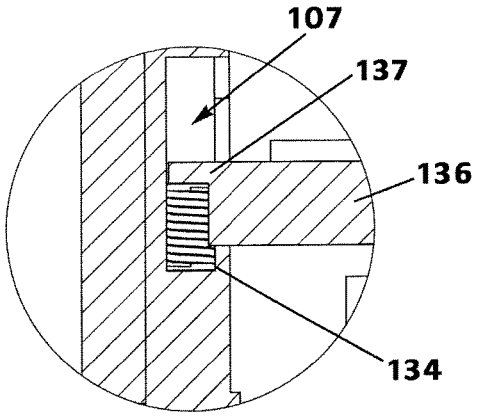
FIG. 4*c* is an isolated view on an enlarged scale taken from FIG. 5*b*, illustrating a compressed spring of the wheel assembly of the automobile jack according to FIG. 1.
Figure 4D:
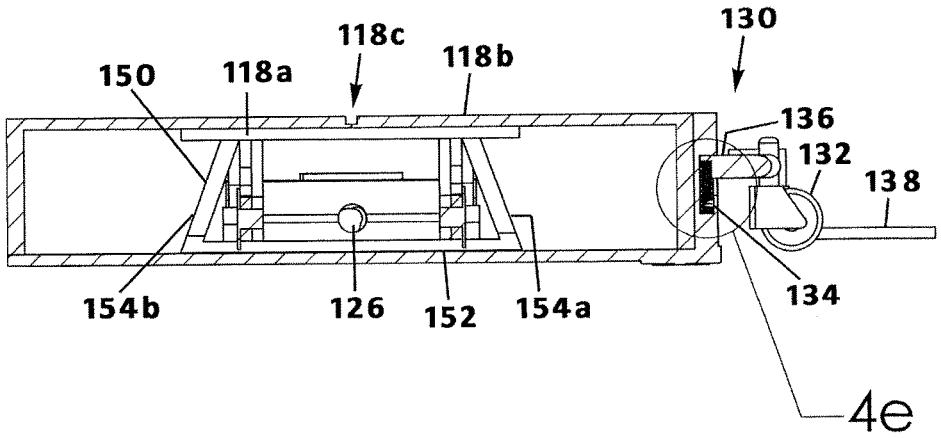
FIG. 4*d* is another section view of the automobile jack according to FIG. 1.
Figure 4E:
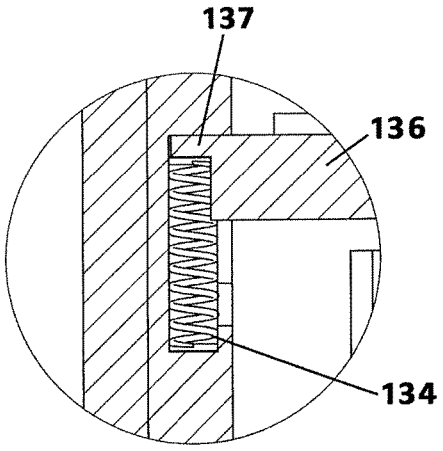
FIG. 4*e* is an isolated view on an enlarged scale taken from FIG. 5*d*, illustrating an expanded spring of the wheel assembly of the automobile jack according to FIG. 1.
Figure 9A:
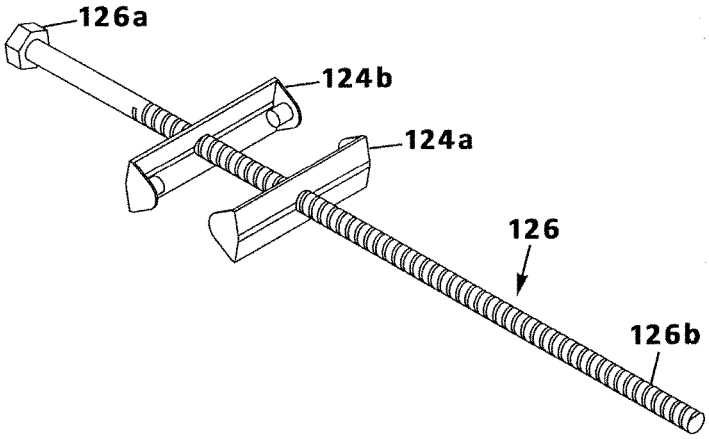
FIG. 9*a* is a perspective view of a power screw engaged with yokes of a scissor lift of the automobile jack, wherein the yokes are close together representing the automobile jack in a raised configuration.
Figure 9B:
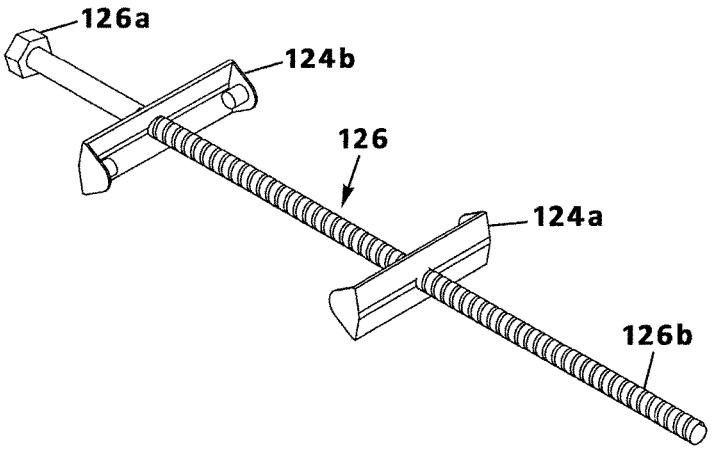
FIG. 9*b* is a perspective view of a power screw engaged with yokes of a scissor lift of the automobile jack, wherein the yokes are spaced apart representing the automobile jack in a retracted configuration.

Each yoke 124 has an opening 125 for receiving a power screw 126. The power screw 126 has an input end 126*a* and a threaded shaft 126*b*. The power screw threaded shaft 126 passes through the opening 125 of the respective yokes 124 for selectively changing the distance between the first and second horizontal axes A1 and A2. Accordingly, the opening 125 of the yoke 124 may be threaded. The power screw input end 126*a* is configured to receive rotational force from an actuator, e.g., an electrically or battery powered impact wrench, the rotational forces causing the power screw 126 to rotate through the respective yokes 124 to change the distance between the first and second horizontal axes A1 and A2. FIGS. 9*a* and 9*b* show the power screw 126 engaged with the first and second yokes 124*a* and 124*b*. In a retracted configuration, the yokes 124*a* and 124*b* are spaced apart, and thus the distance between the horizontal axes A1 and A2 is at a maximum. As the power screw 126 rotates through the respective yokes 124*a* and 124*b*, the yokes 124*a* and 124*b* come together (and thus the distance between the horizontal axes A1 and A2 is minimized) to move the platform 118 to the raised configuration. In FIG. 9*a*, the yokes 124*a* and 124*b* are only slightly separated, representing the jack 100 in a raised configuration. In FIG. 9*b*, the yokes 124*a* and 124*bb* are spaced apart, representing the jack 100 in a lowered configuration. As shown in FIGS. 1 and 2, when the jack 100 is in a lowered configuration, the power screw 126 extends through the respective vertical channels 112 and 199*e*.

Figure 10A:
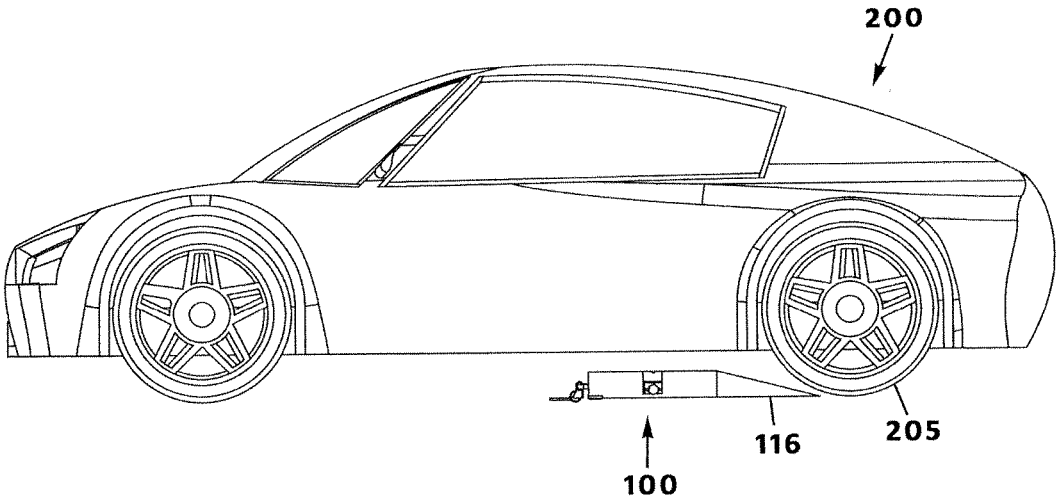
FIG. 10*a* is a side view of the automobile jack according to FIG. 1 prepared to receive the wheel of a vehicle.
Figure 10B:
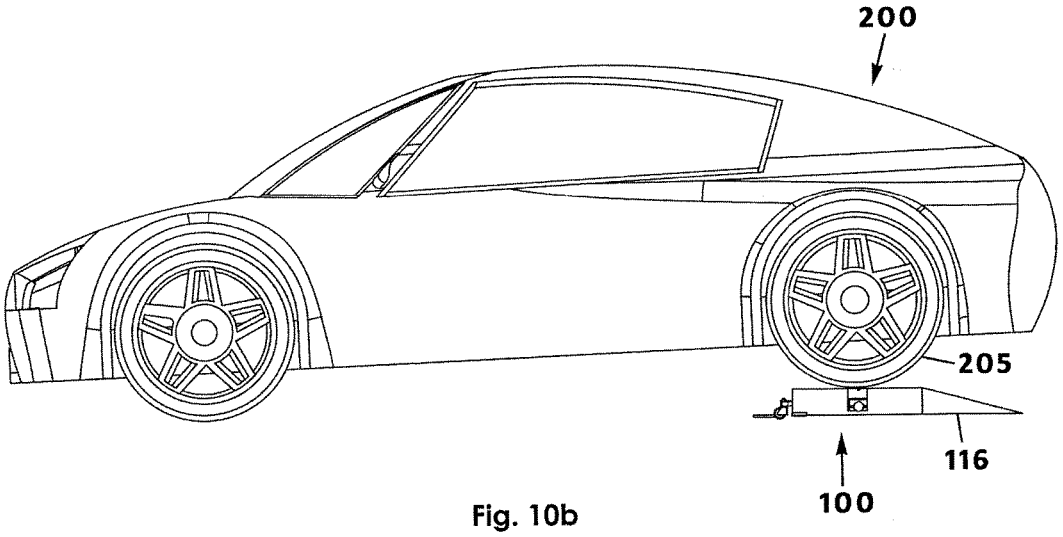
FIG. 10*b* is a side view of a vehicle positioned atop the automobile jack according to FIG. 1.
Figure 11:
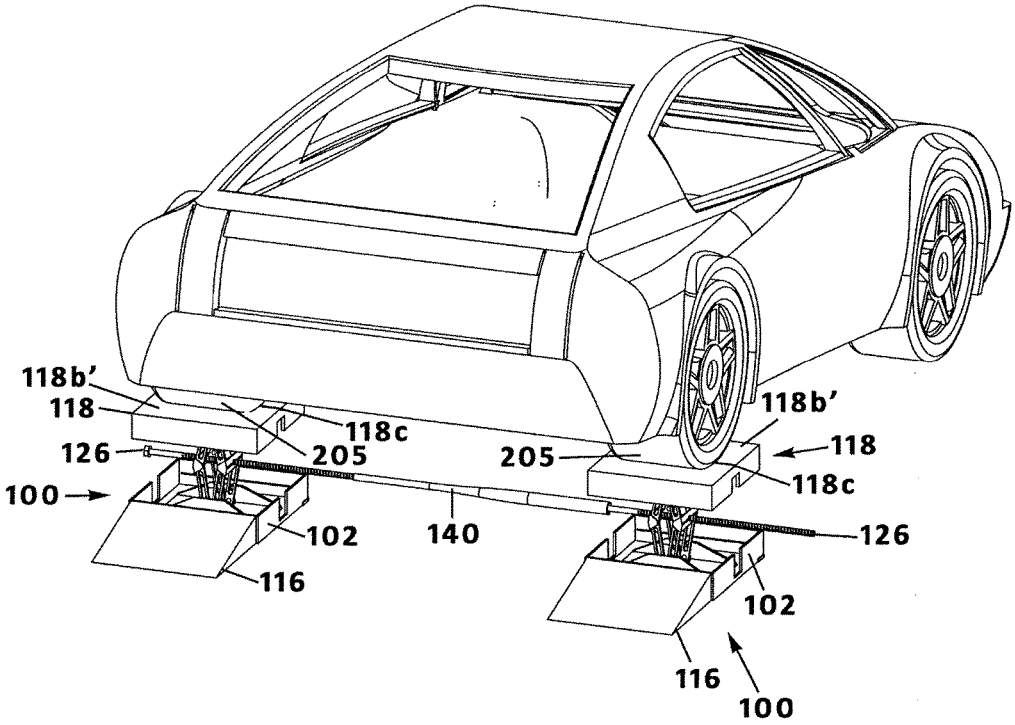
FIG. 11 is a rear perspective view of a vehicle with its rear wheels positioned atop two automobile jacks according to FIG. 1, wherein the jacks are in a raised configuration and connected together via a coupler.
Figure 12:
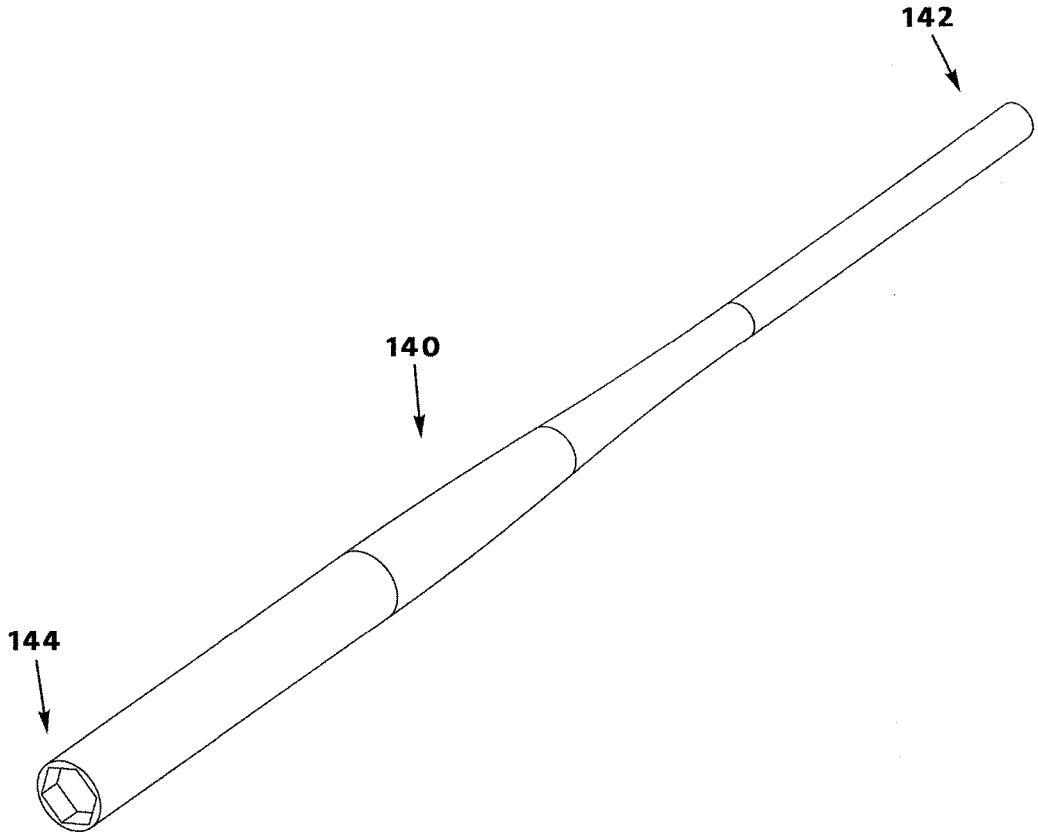
FIG. 12 is a perspective view of a coupler for linking together two automobile jack.
Figure 13A:
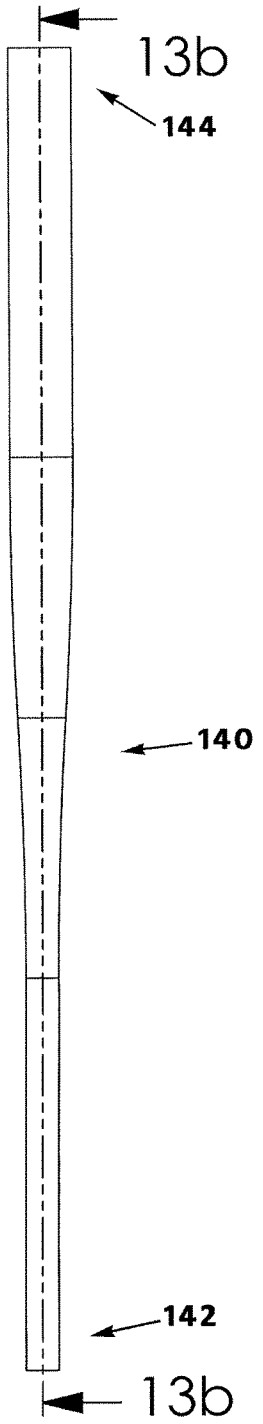
FIG. 13*a* is a top view of the coupler according to FIG. 12.
Figure 13B:
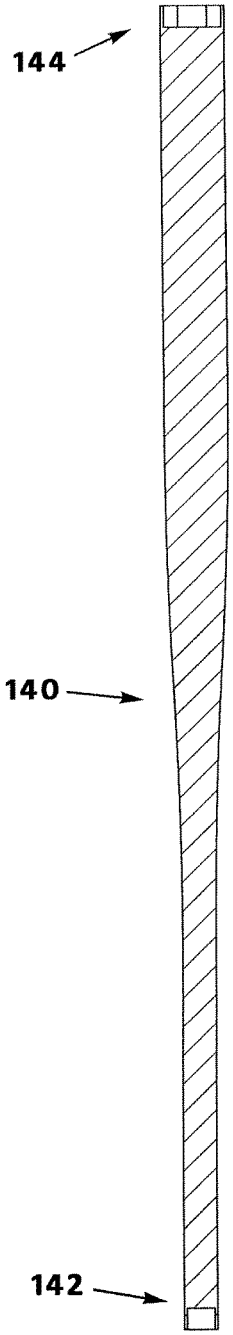
FIG. 13*b* is a section view taken along line 13*b*-13*b* in FIG. 13*a*.

With reference again to FIG. 1, the ramp 116 extends outwardly from the housing 102 at a respective end wall 106*a* or 106*b* (for purpose of discussion only, the ramp 116 is described as extending from the end wall 106*b*). The ramp 116 has an upper end 116*a* and a lower end 116*b* defining an angled platform 117 therebetween. With reference to FIGS. 10*a* and 10*b*, in use, the jack 100 is placed in front of a tire 205 of a vehicle 200. The vehicle 200 is moved until the tire 205 is received into the recessed area 118*b* of the platform 118. Once the tire 205 is in place on the platform 118, the platform 118 can be raised as described herein to provide clearance under the vehicle (FIG. 11).

In an embodiment, it is desirable for two jacks 100 to be coupled together. FIG. 11 shows two jacks 100 and 100' connected together via a coupler 140 and positioned under the rear tires of a vehicle. The second jack 100' is substantially to the jack 100, described above. Referring now to FIGS. 11, 12, and 13*a-b*, an elongate coupler 140 includes a driven end 142 and a driving end 144. The driven end 142 is configured to receive rotational forces from the threaded shaft 126*b* of the power screw 126 of the first jack 100, and the driving end 144 is configured to impart rotational forces onto the input end 126*a* of the power screw 126 of the second jack 100'. The driven end 142 of the coupler 140 is threaded such that it mates with the threaded shaft 126*b* of the power screw 126. In one embodiment, an external diameter of the driven end 142 is smaller than an external diameter of the driving end 144.

Referring now to FIGS. 2, 3*a-b*, and 4*a-e*, in an embodiment, the jack 100 further includes a wheel assembly 130. The wheel assembly 130 includes a wheel 132, a frame 136, and a biasing member 134. In an embodiment, the wheel assembly 130 includes two wheels 132, the frame extending between and connecting the wheels 132. The frame 136 has prongs 137 on either side of the frame 136. The prongs 137 are each received into a cavity 107 defined by an end wall (e.g., the end wall 106*a*) and engage with the biasing member 134, which is disposed within the cavity 107. In a resting configuration, the biasing member 134 is in an expanded position such that it biases the frame 136 (and thus the wheels 132) away from a ground surface. A step plate 138 is secured to the frame 136 (e.g., between the respective wheels 132) for receiving force F, represented by the down arrow in FIG. 3*b*, from a user's foot. When the user steps on the step plate 138, the prongs 137 push against the respective biasing members 134 causing the wheels 132 to engage with the ground surface. When the user takes his foot off of the step plate 138, the biasing members 134 return to the expanded position where the wheels 132 are substantially disengaged from the ground surface.

When the wheels 132 are engaged with the ground surface, the user may be able to move the jack 100 along the ground surface with ease. Additionally, the jack 100 may be self-leveling such that the jack 100 maintains steady engagement with the ground surface as the jack 100 moves from the retracted to the raised configuration and vice versa.

The biasing member 134 is shown in the figures as a helical spring. However, it shall be understood by those of skill in the art that the biasing member 134 can be any appropriate device which can bias the frame 136 as described herein. For example, the biasing member 134 may be a flat spring, a magnetic spring, torsion spring, or the like.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and sub-combinations are of utility and may be employed without reference to other features and sub-combinations and are contemplated within the scope of the claims. The specific configurations and contours set forth in the accompanying drawings are illustrative and not limiting.

What is claimed is:

1. An automobile jack, comprising:

a housing having opposed side walls and opposed end walls, said side walls and said end walls collectively defining a perimeter of a hollow interior area, each said side wall defining a vertical channel with an open top end;

a ramp extending from said housing at a respective said end wall, said ramp having upper and lower ends;

a platform defining a tire-receiving surface;

first and second linkages, said first linkage having an upper arm pivotally connected to a lower arm along a first horizontal axis, said second linkage having an upper arm pivotally connected to a lower arm along a second horizontal axis, each upper arm being pivotally connected to said platform, each lower arm being pivotally connected to said housing;

a threaded yoke coupled to said second linkage, said threaded yoke being fixed along said second horizontal axis;

a power screw for selectively changing a distance between said first and second horizontal axes to thereby move said platform between a retracted configuration at which said tire-receiving surface is no higher than said upper end of said ramp and a raised configuration at which said tire-receiving surface is above said upper end of said ramp, said power screw having an input end and a threaded shaft, said input end being configured to receive rotational forces and rotate said threaded shaft, said threaded shaft being threaded through said threaded yoke, said threaded shaft extending through a respective said vertical channel when said platform is at said retracted configuration;

a wheel assembly having a wheel, a frame, and a biasing member;

wherein:

said wheel and said frame are movable between disengaged and engaged positions;

said wheel is separated from a ground surface when at said disengaged position;

said wheel is in contact with the ground surface when at said engaged position;

said biasing member biasing said wheel and said frame to said disengaged position;

said wheel assembly is adjacent a respective said housing end wall such that said hollow interior area is between said ramp and said wheel.

2. The automobile jack of claim 1, wherein the platform has a first portion coupled to the upper arms and a second portion defining the tire-receiving surface, the second portion of the platform overlying the first portion of the platform.

3. The automobile jack of claim 1, wherein said frame includes a step plate for receiving force from a user's foot to move said wheel and said frame to said engaged position.

4. The automobile jack of claim 1, further comprising an elongate coupler for transferring rotational forces from said power screw threaded shaft to an input end of another power screw.

5. The automobile jack of claim 1, further comprising an elongate coupler for transferring rotational forces from said power screw threaded shaft to an input end of another power screw.

6. A jack system, comprising:

first and second jacks, each comprising:

a housing having first and second opposed side walls and first and second opposed end walls, said side walls and said end walls collectively defining a perimeter of a hollow interior area, each said side wall defining a vertical channel with an open top end;

a ramp extending from said housing at said first end wall, said ramp having upper and lower ends;

a platform defining a tire-receiving surface;

first and second linkages, said first linkage having an upper arm pivotally connected to a lower arm along a first horizontal axis, said second linkage having an upper arm pivotally connected to a lower arm along a second horizontal axis, each upper arm being pivotally connected to said platform, each lower arm being pivotally connected to said housing;

a threaded yoke coupled to said second linkage, said threaded yoke being fixed along said second horizontal axis;

a power screw for selectively changing a distance between said first and second horizontal axes to thereby move said platform between a retracted configuration at which said tire-receiving surface is adjacent said upper end of said ramp and a raised configuration at which said tire-receiving surface is vertically distant from said upper end of said ramp, said power screw having an input end and a threaded shaft, said input end being configured to receive rotational forces and rotate said threaded shaft, said threaded shaft being threaded through said threaded yoke, said threaded shaft extending through said vertical channel of said second side wall when said platform is at said retracted configuration;

an elongate coupler for transferring rotational forces from said power screw threaded shaft of said first jack to said power input end of said second jack;

wherein at least one of said elongate coupler and said power screw of said second jack passing through said vertical channel of said second side wall of said second jack when said platform of said second jack is at said retracted configuration;

wherein:

said first and second jacks each further comprise a wheel assembly having a wheel, a frame, and a biasing member;

said wheel and said frame being movable between disengaged and engaged positions;

said wheel being separated from a ground surface when at said disengaged position;

said wheel being in contact with said ground surface when at said engaged position;

said biasing member biasing said wheel and said frame to said disengaged position.

7. The jack system of claim 6, wherein said frame of each of said first and second jacks includes a step plate for receiving force from a user's foot to move a respective said wheel to said engaged position.

8. The jack system of claim 6, further comprising an elongate coupler having driven and driving ends, said driven end being configured to receive rotational forces from said threaded shaft of said power screw of said first jack, said driving end being configured to impart rotational forces onto said input end of said power screw of said second jack.

9. The jack system of claim 8, wherein said driven end is threaded.

10. The jack system of claim 9, wherein an external diameter of said driven end is smaller than an external diameter of said driving end.

* * * * *